US007367163B2

(12) United States Patent
Brochu et al.

(10) Patent No.: US 7,367,163 B2
(45) Date of Patent: May 6, 2008

(54) FACIA SYSTEM

(76) Inventors: Guy Brochu, 3031 rue des Chatelets # 214, Ste-Foy, Quebec (CA) G1V 2X6; Stéphane Brochu, 890 Beaulieu St., St-Jean-Chrysostome, Quebec (CA) G6Z 2L1

( * ) Notice: Subject to any disclaimer, the term of this patent is extended or adjusted under 35 U.S.C. 154(b) by 239 days.

(21) Appl. No.: 10/780,192

(22) Filed: Feb. 17, 2004

(65) Prior Publication Data

US 2005/0193642 A1 Sep. 8, 2005

(51) Int. Cl.
*E04D 1/36* (2006.01)
*E04D 13/14* (2006.01)
*E04D 3/38* (2006.01)

(52) U.S. Cl. ..... 52/60; 52/97; 52/716.2; 52/718.04; 52/94

(58) Field of Classification Search ..... 52/58, 52/60, 97, 467, 716.2, 717.06, 718.04, 746.11, 52/94; D25/164; 248/48.1, 48.2
See application file for complete search history.

(56) References Cited

U.S. PATENT DOCUMENTS

| | | | | |
|---|---|---|---|---|
| 3,436,877 | A * | 4/1969 | Gunning | 52/11 |
| 4,226,056 | A * | 10/1980 | Hallam | 52/11 |
| 4,461,128 | A * | 7/1984 | Knoebl | 52/94 |
| 4,707,954 | A * | 11/1987 | Butzen | 52/96 |
| 5,170,597 | A * | 12/1992 | Stearns | 52/58 |
| 5,239,791 | A * | 8/1993 | Mills et al. | 52/58 |
| 5,735,084 | A * | 4/1998 | Zaccagni et al. | 52/11 |
| 5,927,023 | A * | 7/1999 | Kittilstad | 52/60 |
| 6,539,675 | B1 * | 4/2003 | Gile | 52/96 |
| 6,912,814 | B1 * | 7/2005 | Inzeo et al. | 52/60 |

* cited by examiner

*Primary Examiner*—Richard E. Chilcot, Jr.
*Assistant Examiner*—Chi Q. Nguyen
(74) *Attorney, Agent, or Firm*—Eric Fincham

(57) ABSTRACT

A facia system for use in a building structure, the facia system having first and second members, a first member having a portion thereof secured to a roof and a drip edge, a second portion being adapted to extend generally vertically and having first cooperative locking section associated therewith, the second member being a facia member which has second cooperative locking arrangement at an upper portion thereof such that when the first and second cooperative locking portions hold the facia member in position, the second member also having an inwardly extending flange arrangement to abut and adjoining soffit.

11 Claims, 6 Drawing Sheets

FACIA SYSTEM

FIELD OF THE INVENTION

The present invention relates to a fascia system for buildings.

BACKGROUND OF THE INVENTION

The fascia is that part of a building where the roof terminates. Typically, most residences and relatively small commercial or industrial establishments utilize a sloping roof. The roof structure includes a plurality of rafters upon which a solid material such as plywood or the like is placed. Subsequently, the weatherproofing component is applied on top thereof, the weatherproofing component typically being asphalt tiles although sheet metal, shakes, other types of tiles, and composite materials are also utilized.

At the point where the rafters terminate, a fascia is installed and extends along the ends of the rafters. Typically, the fascia may comprise a wooden member and/or a metal member secured thereto. Typically, the metal member comprises an L-shaped member which extends along the fascia and inward towards the soffit portion of the eaves.

One of the problems which is frequently encountered is the finishing arrangement such that water will not run back underneath the shingles or other material at the end of the roof. As a result, specially designed drip edges are frequently installed; however, many of these drip edges do not function properly. Thus, it is well known by installers of gutters or eaves troughs that there is almost inevitably some water leakage between the back wall of the gutter and the fascia.

SUMMARY OF THE INVENTION

It is an object of the present invention to provide a fascia arrangement wherein the problem with an effective drip edge is obviated.

It is a further object of the present invention to provide a fascia system wherein a fascia member has an adjustable height.

It is a further object of the present invention to provide a fascia system which is aesthetic and easily installed.

According to one embodiment of the present invention, there is provided a fascia system comprising a first member and a second member, the first member having an upper section designed for securement to an upper surface of a roof member, a drip edge formed at an extremity of the upper section, a transition section extending inwardly and downwardly from said first section; a lower section extending substantially vertically from the transition section, the lower section having first cooperative locking means associated therewith, the second member comprising a fascia member having second cooperative locking means at an upper portion thereof, the first and second cooperative locking means being designed such that the first cooperative locking means engage the second cooperative locking means to thereby hold the fascia member in position, the second member having a generally planar central portion, and an inwardly extending flange arrangement at a bottom end of the generally planar portion to abut an adjoining soffit.

According to a further aspect of the present invention, there is provided in a building having a roof structure including a plurality of sloping rafters extending beyond an adjacent wall structure and which sloping rafters terminate in a fascia and wherein the rafters are covered by a sheet material and a roofing material, the improvement comprising a fascia system, the fascia system comprising a first member and a second member, the first member having an upper section secured to a top surface of the sheet material under the roofing material, a drip edge formed at an extremity of the upper section, the drip edge being spaced outwardly from the rafters and roofing material, a transition section intermediate the upper section and a lower section, the lower section including a generally vertically extending portion, the generally vertically extending portion having first cooperative locking means thereon, the second member comprising a fascia member having second cooperating locking means at an upper portion thereof, the first and second cooperating locking members being engaged such that the fascia member is held in position, the second member having a generally planar central portion, and an inwardly extending flange arrangement at a bottom end of the generally planar portion, the inwardly extending flange abutting an adjoining soffit.

The fascia system of the present invention would typically be manufactured from a sheet metal such as aluminum or an aluminum alloy which can easily be formed into various configurations by known methods. However, it is also within the scope of the invention to use other materials such as a plastic material which could be extruded or otherwise formed into the desired configurations.

As aforementioned, the fascia system includes a first member and a second member, the first member being secured to the building structure and being designed to support the second member in a desired position.

In a preferred embodiment of the invention, the first member has an upper section which is designed for securement to the roof; the upper section would conventionally be secured to the top of the sheet material attached to the rafters—i.e. plywood or other composite products. The means of securing may be any conventional including adhesives and/or mechanical securement means such as nails and screws.

The upper section preferably includes a first portion which is secured to the roof as aforementioned and a second portion which will extend outwardly from the roof edge and which second portion is slightly angled with respect to the first portion. It is the second portion which will terminate in a drip edge.

There is also provided a lower section which includes a generally vertically extending portion designed to lie adjacent the fascia's structure. A transition section extends between the drip edge and the vertically extending portion. In this respect, from the drip edge, there is preferably provided a segment which extends upwardly to thereby define the drip edge and which will then extend downwardly to the generally vertically extending portion.

The generally vertically extending portion will have a first cooperative locking means associated therewith. Although many such cooperative locking means can be envisaged, one of the simpler structures will include a formed hook and recess engagement as will be discussed hereinbelow.

The second member is the portion which covers the fascia. At the upper end, the second member is provided with a second cooperative locking means designed to engage with the first cooperative locking means. Conveniently, as aforementioned, this may be provided by a plurality of hooks or projections extending outwardly from the second member and which are designed to engage within recesses or other supports of the first cooperative locking means. An advantage of such an arrangement is that they may easily be provided by conventional metal forming equipment well known in the art.

Preferably, the first and second cooperative locking means are adjustable with respect to each other such that they may be engaged in different positions. By so doing, a arrangement is provided for differing fascia heights.

The second member, as aforementioned, actually forms or covers the fascia and as such, is substantially plainer in nature although certain embossing or spacing projections may be provided as will be discussed with respect to the preferred embodiment.

At the lower end, the second member is provided with an inwardly extending portion which is designed to abut the soffit structure of the building. In a particularly preferred arrangement, the lower portion of the second member is formed to have a recess at a lower extremity defined by the lower portion of the vertically extending wall and the inwardly extending portion. This recess may be utilized to accommodate a tensioning member which is secured to the roof structure and which engages the lower portion of the second member. To this end, the tensioning member will, as aforementioned, be secured to the roof structure and have a downwardly extending portion designed to seat within the aforesaid recess. Preferably, the tensioning member has a certain resilience and to this end, may be provided with a sinusoidal portion to provide the desired resiliency.

BRIEF DESCRIPTION OF THE DRAWINGS

Having thus generally described the invention, reference will be made to the accompanying drawings illustrating an embodiment thereof, in which.

Figure 1:
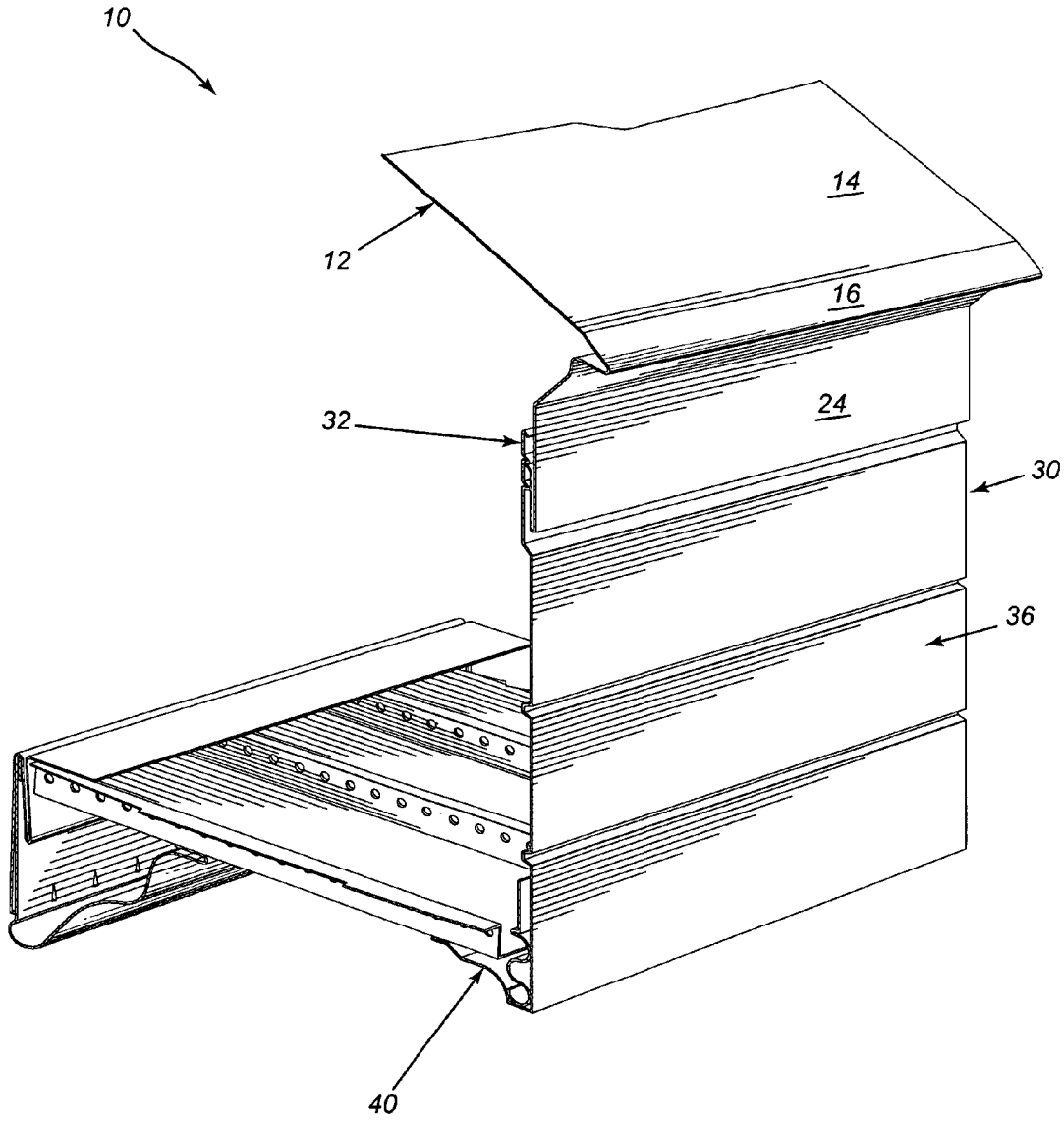
FIG. 1 is a perspective view of a fascia and soffit arrangement employing the fascia system of the present invention.

Referring to the drawings in a greater detail and by reference characters thereto, the fascia system of the present invention is generally designated by reference numeral 10 and includes a first upper member designated by reference numeral 12 and which will now be referred to.

First upper member 12 includes a first upper section generally designated by reference numeral 11 and which includes a planar portion 14 which is designed to lie adjacent to a roof structure R such as is employed in a conventional house. In this respect, it will be understood that under normal circumstances, planar portion 14 will lie on the roof under the shingles or other similar roof covering.

From planar portion 14, upper section 111 includes a downwardly inclined portion 16 which is angled with respect to planar portion 14 and which terminates in a drip edge 18.

From drip edge 18, first upper member 12 has a transition section 15 comprising an upwardly and inwardly extending portion 20 which ensures the proper formation of the drip edge 18. Subsequently, there is provided a second downwardly inclined portion 22 which terminates in a lower section which comprises an outer vertical wall 24. The material forming first upper member 12 then is folded to have an inner vertical wall 26 which is formed with a plurality of recesses 28.

A second lower member generally designated by reference numeral 30 has an upper portion 32 with a plurality of hook-shaped projections 34 formed therein.

Second lower member 30 also includes a main planar portion generally designated by reference numeral 36 and which has formed therein a plurality of spacer projections 38. At its lower end, second lower member 30 has an inwardly extending flange portion generally designated by reference numeral 40. Inwardly extending flange portion 40 has a first horizontal section 42 which joins an arcuately upwardly concave portion 44. There is thus formed a cavity generally designed by reference numeral 45. At the end of arcuate section 44, there is provided a diagonally upwardly extending section 46 which terminates in a horizontal end portion 48.

Figure 2:
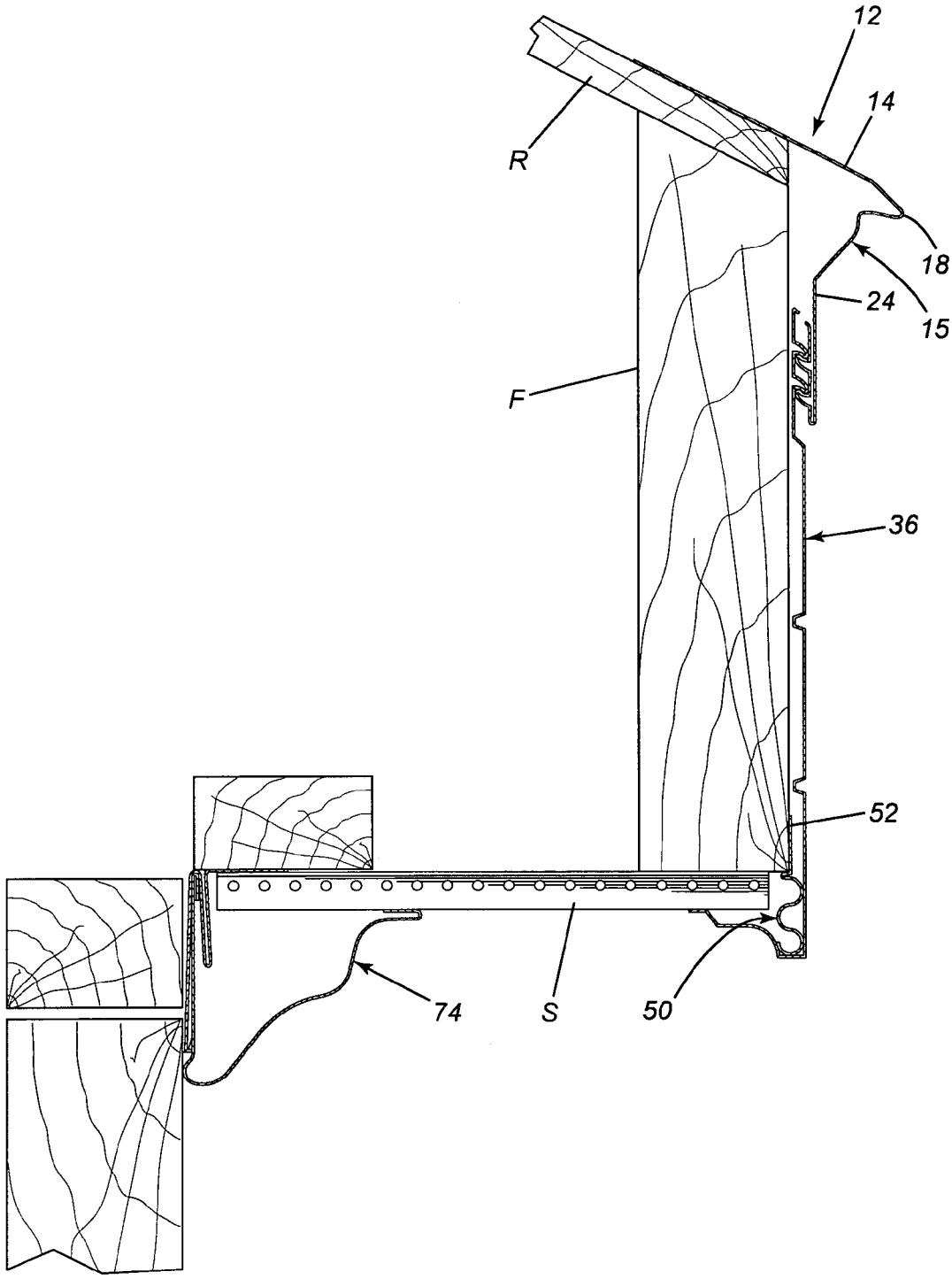
FIG. 2 is a side elevational view of the fascia system of the present invention illustrating the mounting thereof on a portion of a structure.
Figure 3:
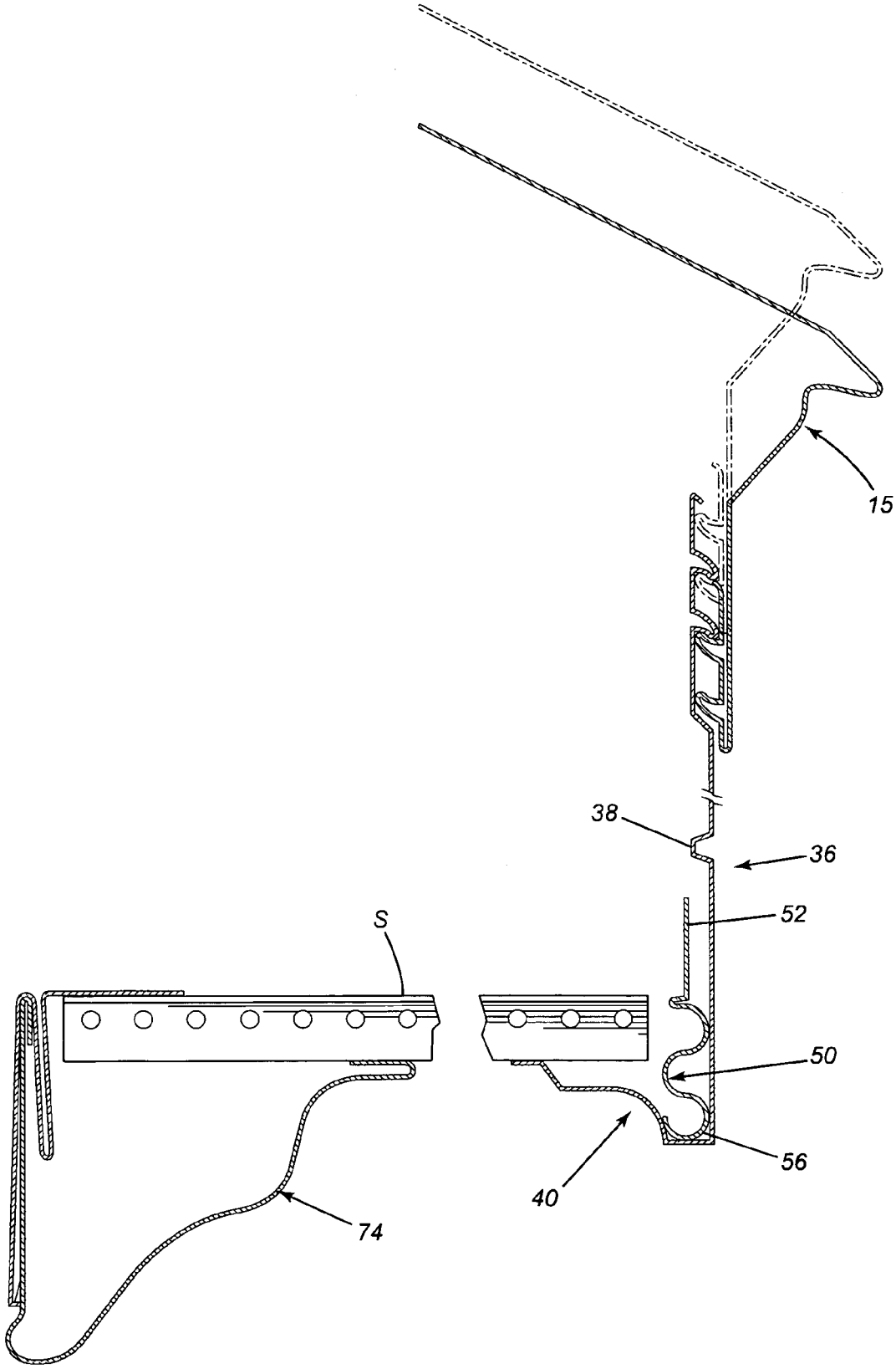
FIG. 3 is a view similar to FIG. 2 with the structural components of the housing structure being removed and showing the adjustability of the system.
Figure 4:
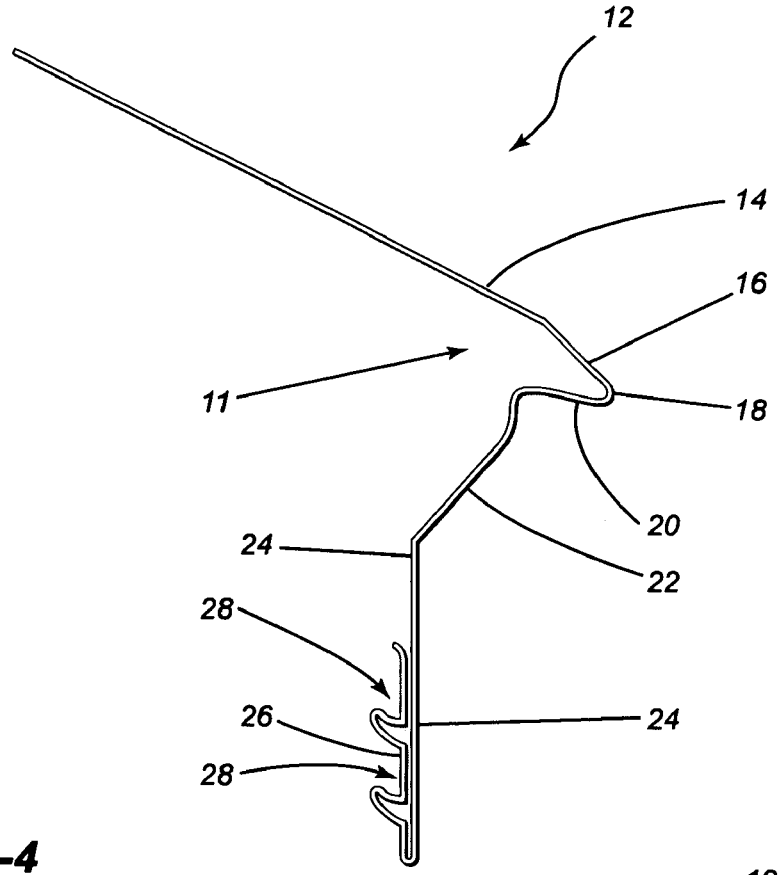
FIG. 4 is a side elevational view of the upper member of the fascia system.
Figure 5:
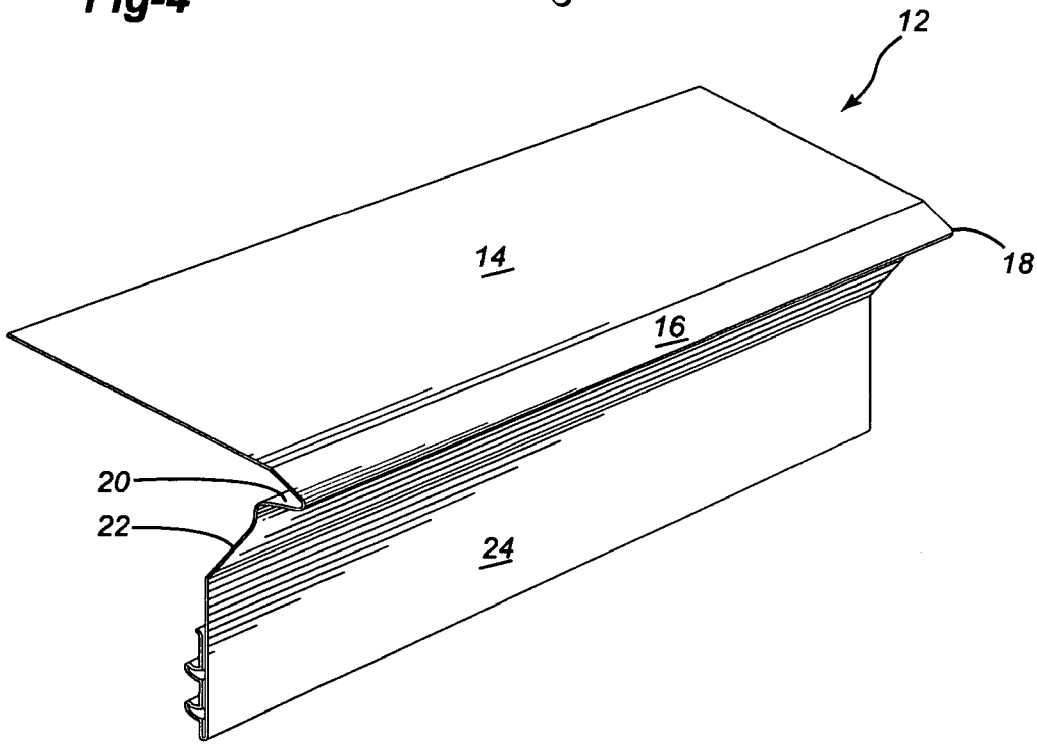
FIG. 5 is a perspective view thereof.
Figure 6:
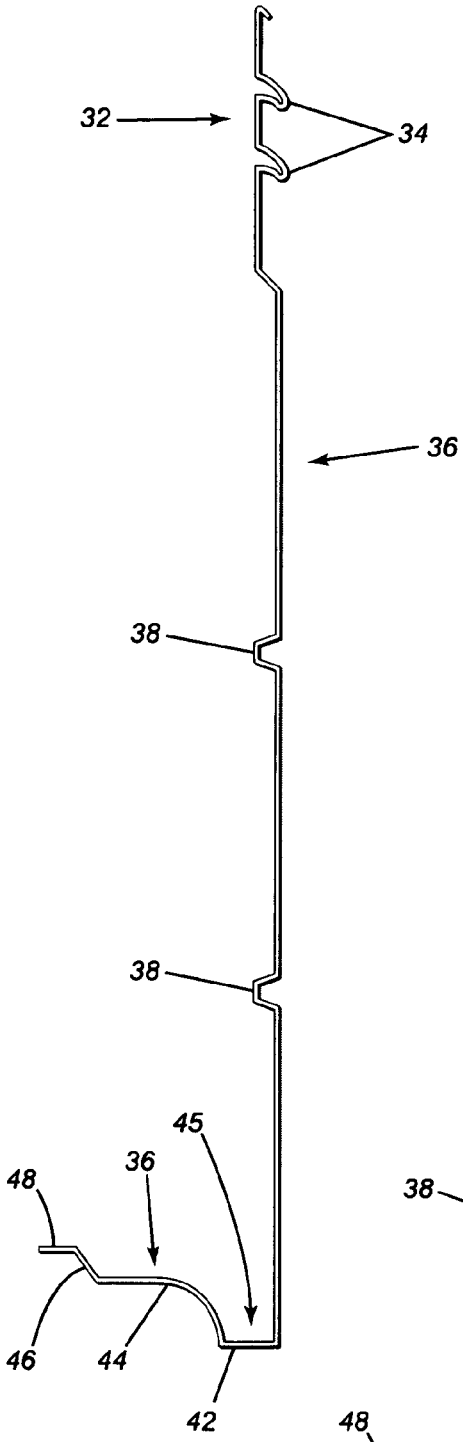
FIG. 6 is a side elevational view of the lower member of the fascia system according to the present invention.
Figure 7:
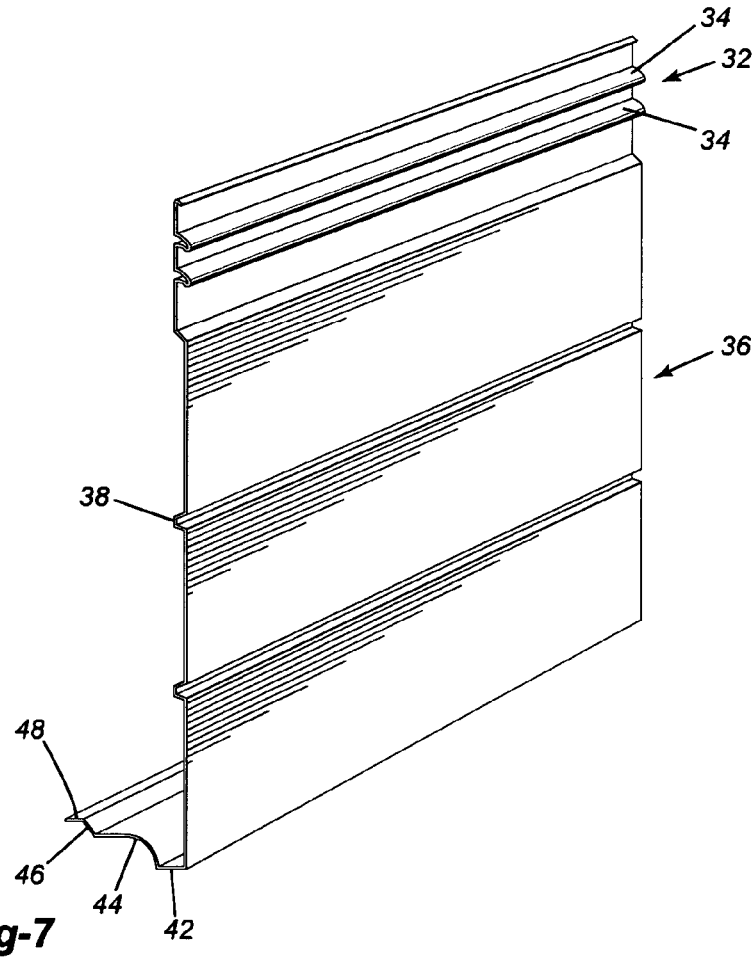
FIG. 7 is a perspective view thereof.
Figure 8:
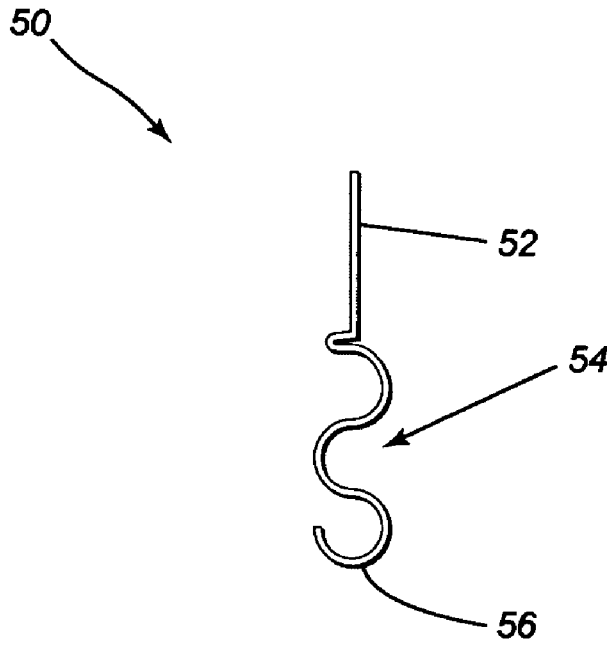
FIG. 8 is side elevational view of a tensioning member which can be utilized in the fascia system of the present invention.
Figure 9:
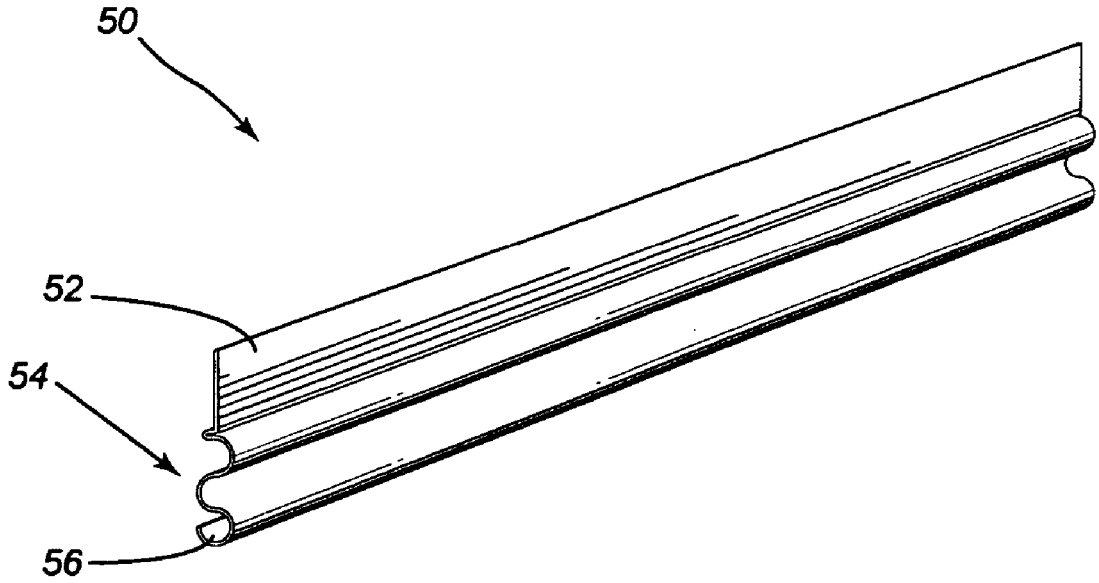
FIG. 9 is a perspective view thereof.

As shown in FIGS. 2 and 3, there is also provided a spacer and tensioning member 50. Spacer and tensioning member 50 is illustrated in FIGS. 8 and 9 includes an upper planar portion 52, and a sinuous section generally designated by reference numeral 54 and which includes a plurality of arcuate sections in an overall S-shaped configuration. Sinuous section 54 terminates in a bottom section generally designated by reference numeral 56 and which is designed to seat within cavity 45.

In use, and referring to FIGS. 2 and 3, first member 12 is installed in a position on roof R with planar portion 14 being secured thereto by suitable means (not shown). This thus provides a drip edge 18 with vertical portions 24 and 26 lying parallel to a fascia board F.

Spacer and tensioning member 50 may then be secured in the position to fascia board F and subsequently, second member 30 is hung in a position and supported by first member 12. In this regard, hook shaped projections 34 are engaged within recesses 28 of first member 12. Spacer and tensioning member 50 seats within cavity or a pocket 45 of second member 30 and maintains a tension on second member 30 to ensure hook shaped projections 34 remain engaged within recesses 28. Inwardly extending flange portion 40 is arranged to engage a soffit S and support one edge thereof. The other edge of soffit S is supported by a suitable supporting member 74 as is disclosed in co-pending application Ser. No. 10/797,830 published as Publication No. 20050223657.

As seen in FIG. 3, the structure of the present invention provides for adjustability as shown in the dashed and complete lines. Thus, a first member 12 may assume different positions depending upon the particular engagement of projections 34 with recesses 28.

It will be understood that the above described embodiments are for purposes of illustration only and that changes and modifications may be made thereto without departing from the spirit and scope of the invention.

We claim:

1. A fascia system comprising:

a first member and a second member;

said first member having an upper section designed for securement to an upper surface of a roof member;

a drip edge formed at an extremity of said upper section;

a transition section extending inwardly and downwardly from said first section;

a lower section extending substantially vertically from said transition section, said lower section having first cooperative locking means associated therewith;

said second member comprising a fascia member having second cooperative locking means at an upper portion thereof, said first and second cooperative locking means being designed such that said first cooperative locking means engage said second cooperative locking means to thereby hold said fascia member in position, said second member having a generally planar central portion; and an inwardly extending flange arrangement at a bottom end of said generally planar portion to abut an adjoining soffit.

2. The fascia system of claim 1 wherein said upper section of said first member includes a first portion for securement to said roof and a second portion angled downwardly with respect to said first portion.

3. The fascia system of claim 1 wherein said first member and second member are formed of a metallic sheet material.

4. The fascia system of claim 3 wherein said sheet material is aluminum.

5. The fascia system of claim 1 further including a tensioning member, said tensioning member being designed to be secured to a building structure and to contact said inwardly extending flange arrangement of said second member and to thereby maintain a pressure thereon.

6. In a building having a roof structure including a plurality of sloping rafters extending beyond an adjacent wall structure and which sloping rafters terminate in a fascia and wherein said rafters are covered by a sheet material and a roofing material, the improvement comprising a fascia system, said fascia system comprising:

a first member and a second member;

said first member having an upper section secured to a top surface of said sheet material under said roofing material;

a drip edge formed at an extremity of said upper section, said drip edge being spaced outwardly from said rafters and roofing material;

a transition section intermediate said upper section and a lower section;

said lower section including a generally vertically extending portion, said generally vertically extending portion having first cooperative locking means thereon;

said second member comprising a fascia member having second cooperating locking means at an upper portion thereof, said first and second cooperating locking members being engaged such that said fascia member is held in position;

said second member having a generally planar central portion; and an inwardly extending flange arrangement at a bottom end of said generally planar portion, said inwardly extending flange abutting an adjoining soffit.

7. The improvement of claim 6 wherein said first member and said second member are formed of a metallic sheet material.

8. The improvement of claim 6 further including a tensioning member, said tensioning member being secured to said roof structure whereby said tensioning member extends downwardly to abut said inwardly extending flange arrangement.

9. A fascia system comprising:

a first member and a second member;

said first member having an upper section designed for securement to an upper surface of a roof member;

a drip edge formed at an extremity of said upper section;

a transition section having a first portion extending upwardly and inwardly from said drip edge and a second portion extending downwardly;

a lower section extending substantially vertically from said transition section, said lower section having first cooperative locking means associated therewith;

said second member comprising a fascia member having second cooperative locking means at an upper portion thereof, said first and second cooperative locking means being designed such that said first cooperative locking means engage said second cooperative locking means to thereby hold said fascia member in position, said second member having a generally planar central portion; and an inwardly extending flange arrangement at a bottom end of said generally planar portion to abut an adjoining soffit.

10. A fascia system comprising:

a first member and a second member;

said first member having an upper section designed for securement to an upper surface of a roof member;

a drip edge formed at an extremity of said upper section;

a transition section extending inwardly and downwardly from said first section;

a lower section extending substantially vertically from said transition section, said lower section having first cooperative locking means associated therewith;

said second member comprising a fascia member having second cooperative locking means at an upper portion thereof, said first and second cooperative locking means being designed such that said first cooperative locking means engage said second cooperative locking means to thereby hold said fascia member in position, said second member having a generally planar central portion, said second cooperative locking means comprising a plurality of outwardly extending projections and said first cooperative locking means comprising recess portions to receive said projections such that said second member is supported by said first member; and an inwardly extending flange arrangement at a bottom end of said generally planar portion to abut an adjoining soffit.

11. A fascia system comprising:

a first member and a second member;

said first member having an upper section designed for securement to an upper surface of a roof member;

a drip edge formed at an extremity of said upper section;

a transition section extending inwardly and downwardly from said first section;

a lower section extending substantially vertically from said transition section, said lower section having first cooperative locking means associated therewith;

said second member comprising a fascia member having second cooperative locking means at an upper portion thereof, said first and second cooperative locking means being designed such that said first cooperative locking means engage said second cooperative locking means to thereby hold said fascia member in position, said second member having a generally planar central portion, said second member having a plurality of spacing projections formed on said generally planar central portion; and an inwardly extending flange arrangement at a bottom end of said generally planar portion to abut an adjoining soffit.

* * * * *